US006501843B2

(12) United States Patent
Usui et al.

(10) Patent No.: US 6,501,843 B2
(45) Date of Patent: Dec. 31, 2002

(54) AUTOMOTIVE AUDIO REPRODUCING APPARATUS

(75) Inventors: Junichi Usui, Tokyo (JP); Tetsunori Itabashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/950,722

(22) Filed: Sep. 12, 2001

(65) Prior Publication Data

US 2002/0034308 A1 Mar. 21, 2002

(30) Foreign Application Priority Data

Sep. 14, 2000 (JP) ..... 2000-279559

(51) Int. Cl.[7] ..... H04R 5/02; H04R 5/00

(52) U.S. Cl. ..... 381/302; 381/18; 381/86

(58) Field of Search ..... 381/302, 300, 381/87, 332, 333, 334, 86, 386, 389, 395, 17, 18, 19

(56) References Cited

U.S. PATENT DOCUMENTS 4,594,729 A * 6/1986 Weingartner ..... 381/18
4,769,843 A * 9/1988 Imai et al. ..... 381/86
4,866,776 A * 9/1989 Kasai et al. ..... 381/86
5,068,897 A * 11/1991 Yamamoto et al. ..... 381/86
5,073,944 A * 12/1991 Hirasa ..... 381/102
5,285,503 A * 2/1994 Satoh et al. ..... 381/17
5,710,818 A * 1/1998 Yamato et al. ..... 381/1
5,883,961 A * 3/1999 House et al. ..... 381/1
6,067,360 A * 5/2000 Kasai et al. ..... 381/18
6,307,941 B1 * 10/2001 Tanner, Jr. et al. ..... 381/17

* cited by examiner

*Primary Examiner*—Xu Mei
(74) *Attorney, Agent, or Firm*—Frommer Lawrence & Haug LLP; William S. Frommer

(57) ABSTRACT

An automotive audio reproducing apparatus according to the present invention comprises: a sound image position correction circuit 52 for converting a left-channel input digital audio signal XL(Z) and a right-channel input digital audio signal XR(Z) into a digital audio signal YL(Z) and a digital audio signal YR(Z), respectively, for output expressed by:

$$YL(Z)\cdot GLL(Z)+YR(Z)\cdot GLR(Z)=XL(Z)\cdot FLL(Z)+XR(Z)\cdot FLR(Z)$$

$$YR(Z)\cdot GLL(Z)+YL(Z)\cdot GLR(Z)=XR(Z)\cdot FLL(Z)+XL(Z)\cdot FLR(Z)$$

where FLL(Z) to GLR(Z) are given head related transfer functions; a depth correction circuit 53 for adding reflected sound signals to the signals YL(Z) and YR(Z), respectively; a D/A converter circuit 6 for subjecting output signals of the correction circuit 53 to D/A conversion; and a level control circuit 522 for controlling level of a difference signal in the sound image position correction circuit 52; whereby analog audio signals outputted from the D/A converter circuit 6 are supplied to a left-channel speaker and a right-channel speaker, respectively.

5 Claims, 12 Drawing Sheets

AUTOMOTIVE AUDIO REPRODUCING APPARATUS

BACKGROUND OF THE INVENTION

The present invention relates to an automotive audio reproducing apparatus.

When an audio reproducing apparatus reproduces music or the like, ideal height of a reproduced sound image is said to be eye level of the listener. Therefore, speakers are generally mounted at the eye level of the listener.

However, with an automotive audio reproducing apparatus, it is difficult to mount speakers at the eye level of the listener (driver or passenger of the vehicle, that is, an occupant). As shown in FIG. 12A, the speakers are often mounted at a lower position (1) of front doors of the vehicle or at a lower position (2) of rear doors. Hence, reproduced sound is heard from the direction of the lower position, so that the sound image is localized at a position lower than the eye level of the listener.

In order to avoid such a problem, there is a method of mounting speakers of small diameter for reproducing high frequencies at a position (3) in front of the listener, as shown in FIG. 12A. However, this method causes reproduced sound at high frequencies and reproduced sound at low frequencies to be outputted from different positions, thereby resulting in separate reproduced sounds.

Also, it is known that sound tends to be absorbed more as its frequency is increased. Therefore, when the speakers are mounted at a lower position in a passenger compartment, high-frequency sound is absorbed by the seats and the interior of the compartment. This results in a difference between the reproduced sound outputted by the audio reproducing apparatus and the sound actually heard by the listener.

In order to deal with the above situation, it is effective to actually determine transfer functions in the compartment and correct the reproduced sound according to the transfer functions. However, this requires a high-performance digital signal processing apparatus. Since such a digital signal processing apparatus is rather expensive, it is difficult to use it in a consumer audio reproducing apparatus.

In addition, when the reproduced sound is corrected according to transfer functions, high frequencies generally tend to be emphasized. Therefore, when sound volume level is increased, high-frequency sound becomes excessively noticeable.

Furthermore, the passenger compartment is rather small when viewed as an acoustic space, and therefore affects the reproduced sound. Thus, the reproduced sound actually heard by the listener lacks in breadth and depth.

SUMMARY OF THE INVENTION

The present invention has been made to solve the above problems.

Thus, according to the present invention, there is provided an automotive audio reproducing apparatus comprising:

a sound image position correction circuit for converting a left-channel input digital audio signal XL(Z) and a right-channel input digital audio signal XR(Z) into a digital audio signal YL(Z) and a digital audio signal YR(Z), respectively, for output expressed by:

$$YL(Z)\cdot GLL(Z)+YR(Z)\cdot GLR(Z)=XL(Z)\cdot FLL(Z)+XR(Z)\cdot FLR(Z)$$

$$YR(Z)\cdot GLL(Z)+YL(Z)\cdot GLR(Z)=XR(Z)\cdot FLL(Z)+XL(Z)\cdot FLR(Z)$$

where

FLL(Z) is a head related transfer function from a first left-channel speaker and a first right-channel speaker located in front of a listener in a passenger compartment to a left ear and a right ear of the listener, respectively;

FLR(Z) is a head related transfer function from the first left-channel speaker and the first right-channel speaker to the right ear and the left ear of the listener, respectively;

GLL(Z) is a head related transfer function from a second left-channel speaker and a second right-channel speaker located in lower front of the listener to the left ear and the right ear of the listener, respectively; and GLR(Z) is a head related transfer function from the second left-channel speaker and the second right-channel speaker to the right ear and the left ear of the listener, respectively;

a reflected sound signal generating circuit for generating reflected sound signals by delaying the output signals YL(Z) and YR(Z), respectively;

a pair of adding circuits for adding the reflected sound signals to the output signals YL(Z) and YR(Z), respectively; and a D/A converter circuit for being supplied with output signals of the pair of adding circuits;

wherein when $$Hp(Z)=(FLL(Z)+FLR(Z))/(GLL(Z)+GLR(Z))$$

$$Hm(Z)=(FLL(Z)-FLR(Z))/(GLL(Z)-GLR(Z)),$$

the sound image position correction circuit includes:

a first adding circuit and a first subtracting circuit for subjecting the input digital audio signals XL(Z) and XR(Z) to addition and subtraction, respectively;

a first digital filter and a second digital filter having transfer characteristics of the Hp(Z) and the Hm(Z) for being supplied with output signals of the first adding circuit and the first subtracting circuit, respectively;

a second adding circuit and a second subtracting circuit for subjecting output signals of the first digital filter and the second digital filter to addition and subtraction and thereby generating the output signals YL(Z) and YR(Z), respectively; and a level control circuit connected in series with the second digital filter in a signal line between the first subtracting circuit and the second adding circuit and the second subtracting circuit;

whereby the level control circuit controls level of a difference signal supplied to the second adding circuit and the second subtracting circuit; and analog signals outputted from the D/A converter circuit are supplied to the second left-channel speaker and the second right-channel speaker, respectively.

Thus, virtual speakers are disposed in front of the listener, and the virtual speakers reproduce a sound field and a sound image.

DETAILED DESCRIPTION OF THE PREFERRED EMBODIMENTS

Outline of Automotive Audio Reproducing Apparatus

Figure 1:
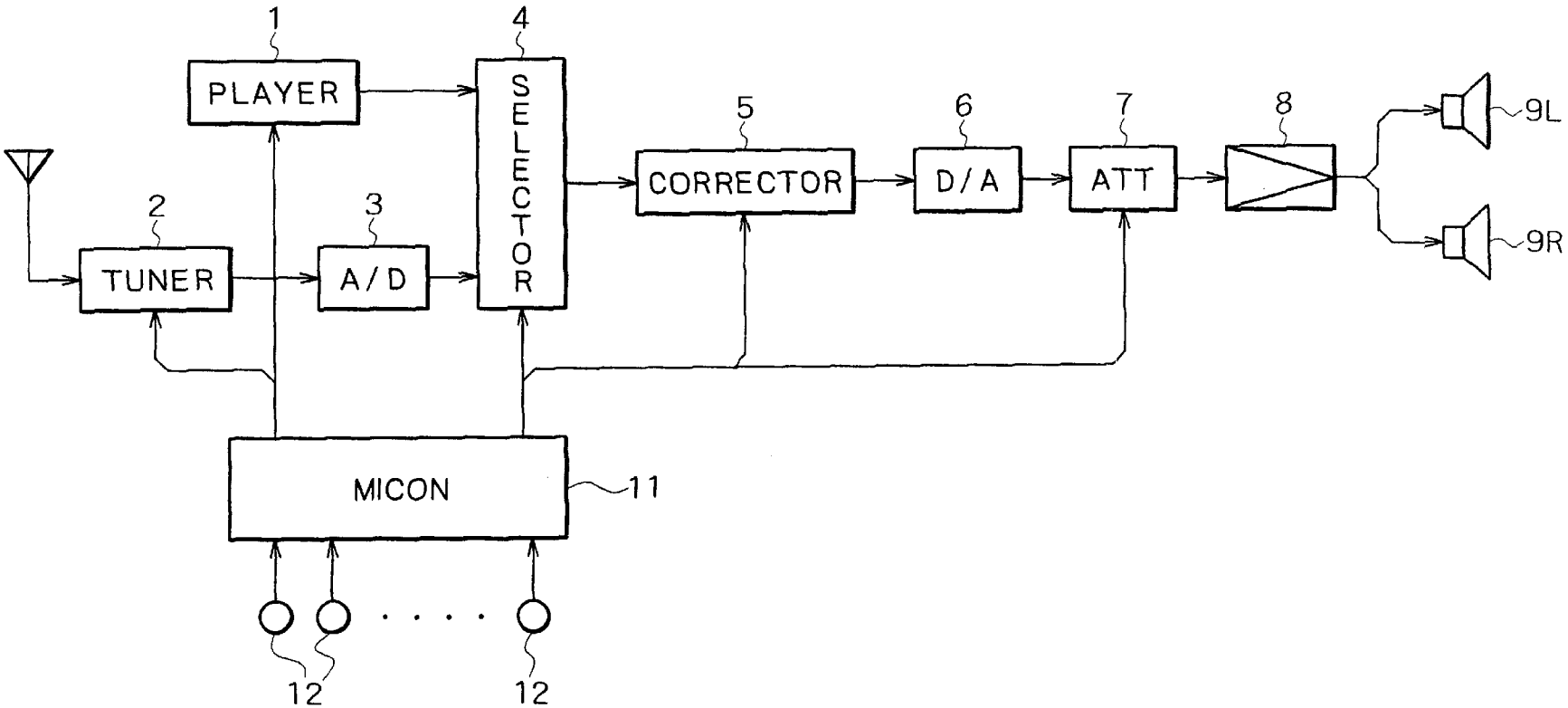
FIG. 1 is a system diagram showing an embodiment of the present invention.

FIG. 1 shows a configuration of an automotive audio reproducing apparatus according to the present invention. Specifically, the automotive audio reproducing apparatus has a CD or MD player 1, for example, as a source of digital audio data. The digital audio data outputted from the player 1 is supplied to an input selector circuit 4.

The automotive audio reproducing apparatus also has an FM tuner 2, for example, as a source of an analog audio signal. The analog audio signal outputted from the tuner 2 is supplied to an A/D converter circuit 3 to be converted into digital audio data. The digital audio data is supplied to the selector circuit 4.

The selector circuit 4 selects a set of digital audio data supplied thereto, and then supplies the selected digital audio data to a digital correction circuit 5. The digital correction circuit 5, which will be described later in detail, is formed by a DSP, for example, and makes corrections such as:

Locating a sound image reproduced by speakers at an ideal position;

Providing reproduced sound with breadth and depth; and

Correcting frequency characteristics and the like.

The corrected digital audio data is supplied to a D/A converter circuit 6 to be converted into an analog audio signal. The audio signal is supplied through an attenuator circuit 7 for adjusting sound volume and then an output amplifier 8 to left- and right-channel speakers 9L and 9R.

Figure 12A:
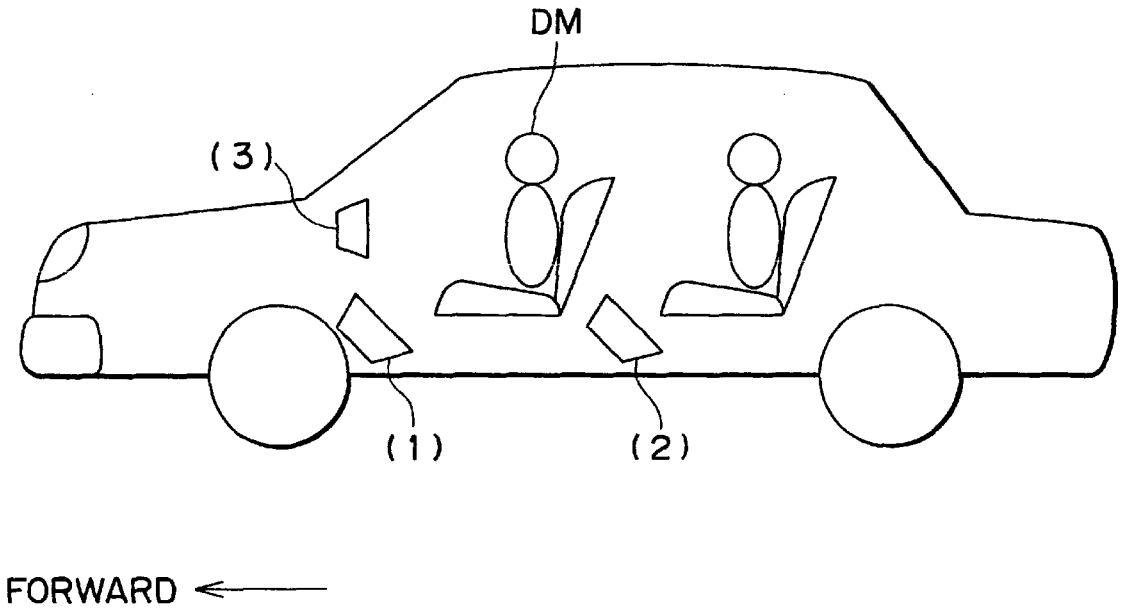
FIGS. 12A and 12B are diagrams of assistance in explaining a sound field in a compartment.

In this case, the speakers 9L and 9R are disposed at a position (1) in FIG. 12A, for example (or may be disposed at the position (1)). Specifically, when the speakers 9L and 9R are intended for a listener in a front seat, the speakers 9L and 9R are disposed at lower positions of front doors on the left side and the right side of the vehicle, respectively.

The automotive audio reproducing apparatus also has a microcomputer 11 for system control. When control keys (control switches) 12 are operated, the microcomputer 11 controls the player 1, the tuner 2, the selector circuit 4, or the attenuator circuit 7 in response to the key operation, thereby changing the source, the sound volume or the like.

Thus, the speakers 9L and 9R output reproduced sound of a CD, an MD, a broadcast or the like. In this case, even when the speakers 9L and 9R are at the position (1) in FIG. 12A, a sound image formed by the reproduced sound is located at eye level of the listener, for example, as a result of correction processing of the digital correction circuit 5. In addition, even in a small passenger compartment, the reproduced sound provides a sense of greater breadth and depth Furthermore, frequency characteristics are corrected for effects specific to the passenger compartment.

Digital Correction Circuit 5

Figure 2:
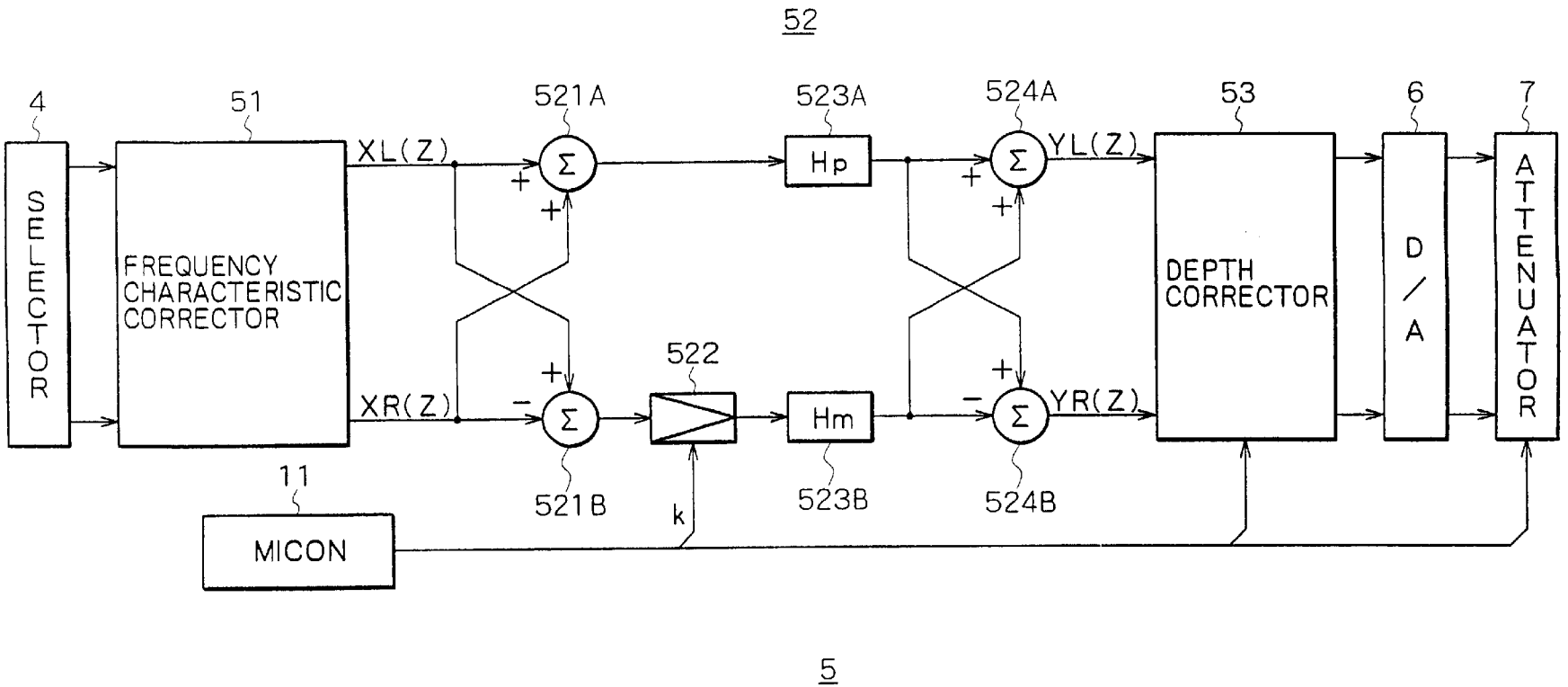
FIG. 2 is a system diagram showing the embodiment of the present invention.

The digital correction circuit 5 makes various corrections as mentioned above. As shown in FIG. 2, the digital correction circuit 5 is equivalently formed by a frequency characteristic correction circuit 51, a sound image position correction circuit 52, and a depth correction circuit 53.

In this case, the frequency characteristic correction circuit 51 is intended to provide appropriate frequency characteristics to an audio signal to be supplied eventually to the speakers 9L and 9R by correcting for change in the frequency characteristics due to the provision of the sound image position correction circuit 52 and irregularities in the frequency characteristics specific to the passenger compartment. The sound image position correction circuit 52 corrects the position of a sound image and also corrects sound breadth. The depth correction circuit 53 corrects sound depth by a reflected sound signal.

Each of the correction circuits 51 to 53 will hereinafter be described. For convenience of description, the correction circuits will be described in order for the correction circuits 52, 53, and 51.

Sound Image Position Correction Circuit 52

The sound image position correction circuit 52 corrects digital audio data so that a sound image is located at eye level of the listener. This correction is realized by using a transfer function that takes into consideration acoustic characteristics in a range from a speaker to the eardrum of the listener, that is, a head related transfer function (HRTF).

In general, the head related transfer function can be determined as follows.

(a) To arrange speakers and a dummy head having a shape of the human head in given positional relation to each other.

(b) To input an impulse signal that becomes flat on a frequency axis after Fourier transformation to the speakers as a test signal. Incidentally, the test signal may be a signal having characteristics of an impulse function such as a time stretched pulse signal.

(c) To measure impulse response in an artificial ear of the dummy head. This impulse response is the head related transfer function in the positional relation of the item (a).

Thus, when the apparatus shown in FIG. 1 and FIG. 2 uses a head related transfer function, (A) As shown in FIG. 12A, a dummy head DM having a shape of the human head is disposed in a front seat of a standard vehicle or a typical vehicle.

(B) Speakers are disposed at an actual speaker position, for example the position (1), and a head related transfer function in this case is determined.

(C) Speakers are disposed at a position where an ideal sound field is to be realized, for example a position (3) on a dashboard, and a head related transfer function in this case is determined.

Then, the sound image position correction circuit 52 corrects digital audio data on the basis of the head related transfer functions of the items (B) and (C). As a result of this data correction, a sound image formed by the speakers 9L and 9R mounted in the position (1) of the front seat doors is corrected to be at the position of a sound image formed by the speakers located at the ideal position (3), as described above.

Figure 5A:
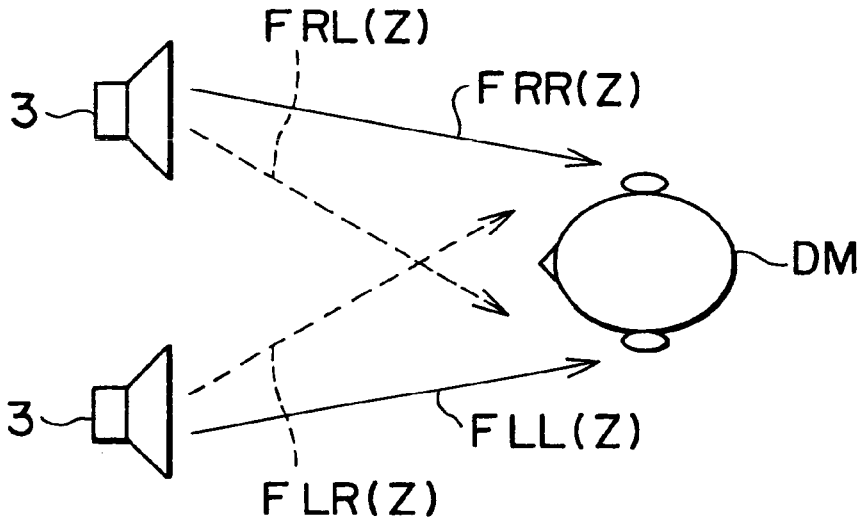
FIGS. 5A and 5B are plan views of assistance in explaining the present invention.
Figure 5B:
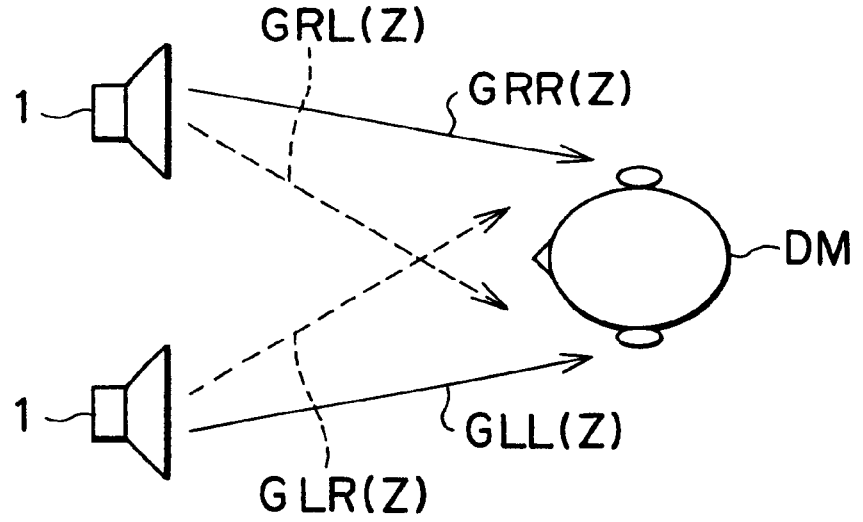

First, suppose that the head related transfer functions HRTF determined and analyzed according to the items (A) to (C) are as follows, as is also shown in FIG. 5.

FLL(Z): HRTF from the left-channel speaker at the position (3) to a left ear.

FLR(Z): HRTF from the left-channel speaker at the position (3) to a right ear.

FRL(Z): HRTF from the right-channel speaker at the position (3) to the left ear.

FRR(Z): HRTF from the right-channel speaker at the position (3) to the right ear.

GLL(Z): HRTF from the left-channel speaker at the position (1) to the left ear.

GLR(Z): HRTF from the left-channel speaker at the position (1) to the right ear.

GRL(Z): HRTF from the right-channel speaker at the position (1) to the left ear.

GRR(Z): HRTF from the right-channel speaker at the position (1) to the right ear.

In this case, as described above, the position (3) is the position of the speakers that realize an ideal sound field or sound image, and the position (1) is the position of the actually mounted speaker 9L or 9R. Each of the head related transfer functions is expressed by a complex number.

Then, suppose:

XL(Z): a left-channel input audio signal (audio signal before correction);

XR(Z): a right-channel input audio signal (audio signal before correction);

YL(Z): a left-channel output audio signal (audio signal after correction); and

YR(Z): a right-channel output audio signal (audio signal after correction).

In order to reduce the amount of data processed by the sound image position correction circuit 52, the sound image position correction circuit 52 is configured assuming that the head related transfer functions are "symmetrical," that is, assuming that the following equations hold.

$$FLL(Z)=FRR(Z) \tag{1}$$

$$FLR(Z)=FRL(Z) \tag{2}$$

$$GLL(Z)=GRR(Z) \tag{3}$$

$$GLR(Z)=GRL(Z) \tag{4}$$

Hence, it is desirable to place the dummy head DM at the center of the front seats in the compartment or at the center of the compartment when the head related transfer functions are determined. This reduces a difference in correction between the seats and makes it possible to provide similar effect of correction for each seat.

In order to make correction so as to provide a sense of hearing sound from the speakers at the position (3) assuming that the equations (1) to (4) hold, it suffices to satisfy the following equations (5) and (6).

$$YL(Z)\cdot GLL(Z)+YR(Z)\cdot GLR(Z)=XL(Z)\cdot FLL(Z)+XR(Z)\cdot FLR(Z) \tag{5}$$

$$YR(Z)\cdot GLL(Z)+YL(Z)\cdot GLR(Z)=XR(Z)\cdot FLL(Z)+XL(Z)\cdot FLR(Z) \tag{6}$$

In this case, Hp(Z) and Hm(Z) are defined as:

$$Hp(Z)=(FLL(Z)+FLR(Z))/(GLL(Z)+GLR(Z)) \tag{7}$$

$$Hm(Z)=(FLL(Z)-FLR(Z))/(GLL(Z)-GLR(Z)) \tag{8}$$

Then, YL(Z) and YR(Z) are:

$$YL(Z)=Hp(Z)\cdot(XL(Z)+XR(Z))/2+Hm(Z)\cdot(XL(Z)-XR(Z))/2 \tag{9}$$

$$YR(Z)=Hp(Z)\cdot(XL(Z)+XR(Z))/2-Hm(Z)\cdot(XL(Z)-XR(Z))/2 \tag{10}$$

It is known that a differential component of a stereo music signal has great effect on a sense of breadth and stereo. The second terms of the equations (9) and (10) are differential components of a stereo signal. Thus, by controlling level of the second terms, it is possible to control a sense of spatial breadth.

Accordingly, when the second terms of the equations (9) and (10) are multiplied by a coefficient k serving as a parameter for controlling the sense of breadth, the equations (9) and (10) are expressed as:

$$YL(Z)=Hp(Z)\cdot(XL(Z)+XR(Z))/2+k\cdot Hm(Z)\cdot(XL(Z)-XR(Z))/2 \tag{11}$$

$$YR(Z)=Hp(Z)\cdot(XL(Z)+XR(Z))/2-k\cdot Hm(Z)\cdot(XL(Z)-XR(Z))/2 \tag{12}$$

When the coefficient k in the equations (11) and (12) is increased, the differential components of the second terms are emphasized, thus increasing the sense of breadth in a reproduced sound field.

According to the equations (11) and (12), the sound image position correction circuit 52 can be formed by filters having characteristics expressed by the equations (7) and (8), a level control circuit, adding circuits, and subtracting circuits.

Thus, the sound image position correction circuit 52 can be formed in a manner as shown in FIG. 2, for example. Specifically, the digital audio data from the frequency characteristic correction circuit 51, which will be described later, is input signals XL(Z) and XR(Z) of the sound image position correction circuit 52, and output signals of the sound image position correction circuit 52 are signals YL(Z) and YR(Z).

The input signals XL(Z) and XR(Z) are supplied to an adding circuit 521A and a subtracting circuit 521B to form a sum signal (XL(Z)+XR(Z)) and a difference signal (XL(Z)−XR(Z)). The sum signal is supplied to a filter circuit 523A. The difference signal is supplied to a level control circuit 522. The level control circuit 522 controls level of the difference signal in such a manner as to correspond to the coefficient k in the equations (11) and (12), and then supplies the result to a filter circuit 523B.

In this case, the filter circuits 523A and 523B are of the FIR type of order 70, for example, and have transfer characteristics expressed by the equations (7) and (8). Then, output signals of the filter circuits 523A and 523B are supplied to an adding circuit 524A and a subtracting circuit 524B in a specified ratio to form the output signals YL(Z) and YR(Z). The signals YL(Z) and YR(Z) are supplied to the D/A converter circuit 6 via the depth correction circuit 53.

Thus, even when the speakers 9L and 9R are mounted in the front seat door position (1), the same sound image as when the speakers 9L and 9R are disposed at the ideal position (3) can be reproduced.

(a) Control of Sense of Breadth

Since as described above, the left- and right-channel differential components of a music signal have great effect on a sense of breadth and stereo of reproduced sound, the sound image position correction circuit 52 in FIG. 2 has the level control circuit 522 to control the level of the differential components in such a manner as to correspond to the coefficient k. Therefore, the sound image position correction circuit 52 can control and also emphasize the sense of spatial breadth of the reproduced sound.

However, when the sense of breadth is emphasized by increasing the level of the differential components, it generally sounds as if the sound volume level is increased. Therefore, when the level control circuit 522 of the sound image position correction circuit 52 in FIG. 2 controls the level of the differential components, the attenuator circuit 7 for adjusting sound volume shown in FIGS. 1 and 2 corrects the level of the analog audio signal to thereby correct the volume of the reproduced sound.

Thus, the reproducing apparatus of FIG. 1 can correct the position of a sound image so that the sound image is at eye level, and also provide sufficient sound breadth or even emphasize the sense of sound breadth.

Simplification of Sound Image Position Correction Circuit 52

Figure 6:
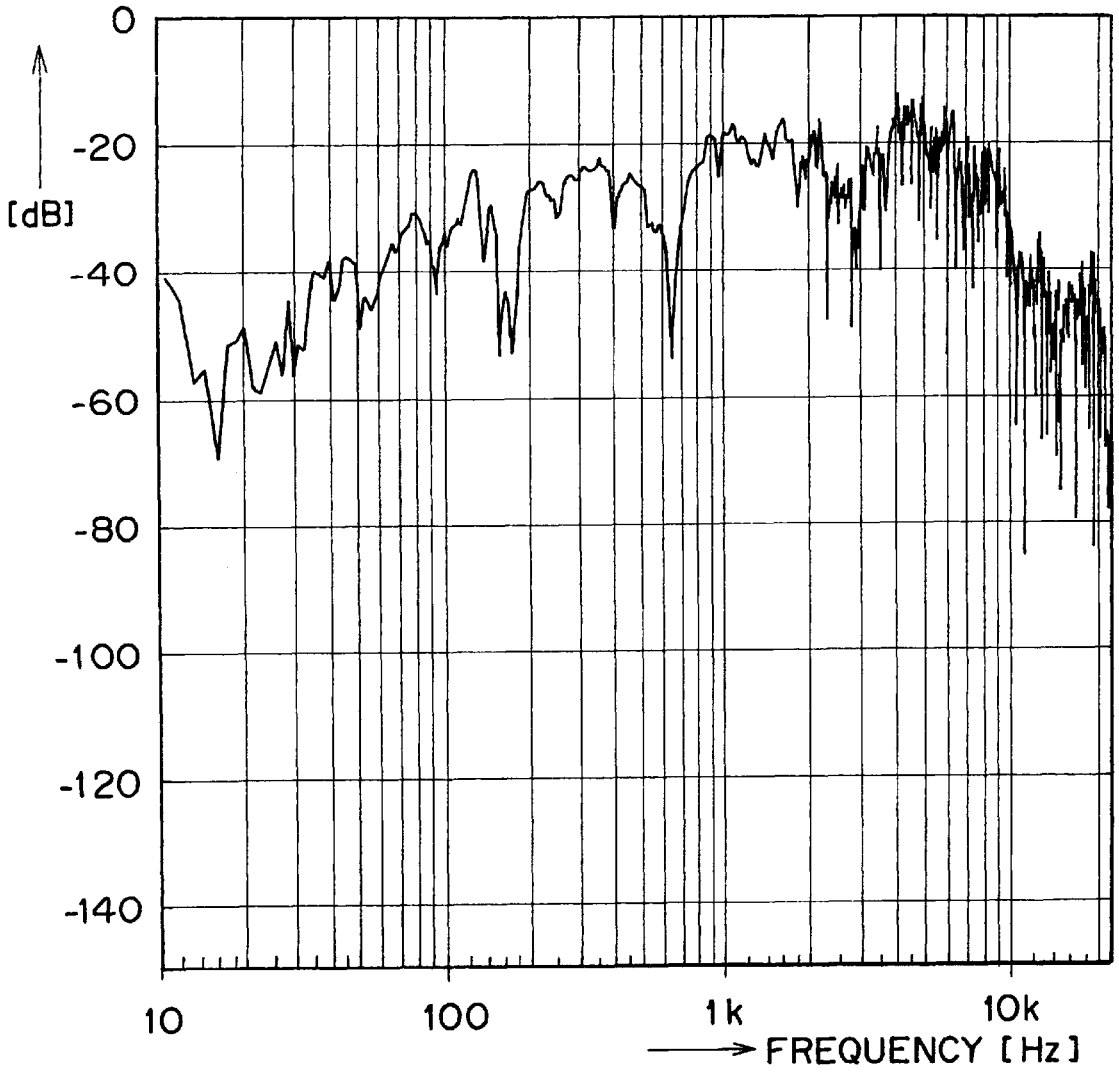
FIG. 6 is a characteristic diagram of assistance in explaining the present invention.

FIG. 6 shows an example of measurement of impulse response. The figure shows a result of measurement of impulse response from the speaker disposed at the door position (1) on the left side of the front seats of the vehicle to the left ear of the dummy head DM disposed at the center of the front seats.

As is clear from the result of measurement, the impulse response has great peaks and dips. When the peaks and dips are applied to the sound image position correction circuit 52 as they are, the order of the filter circuits 523A and 523B is increased, and thus large-scale processing is required.

Thus, a method of simplifying the sound image position correction circuit 52 by simplifying the filter circuits 523A and 523B will be described in the following.

(a) Averaging on Frequency Axis

Figure 7:
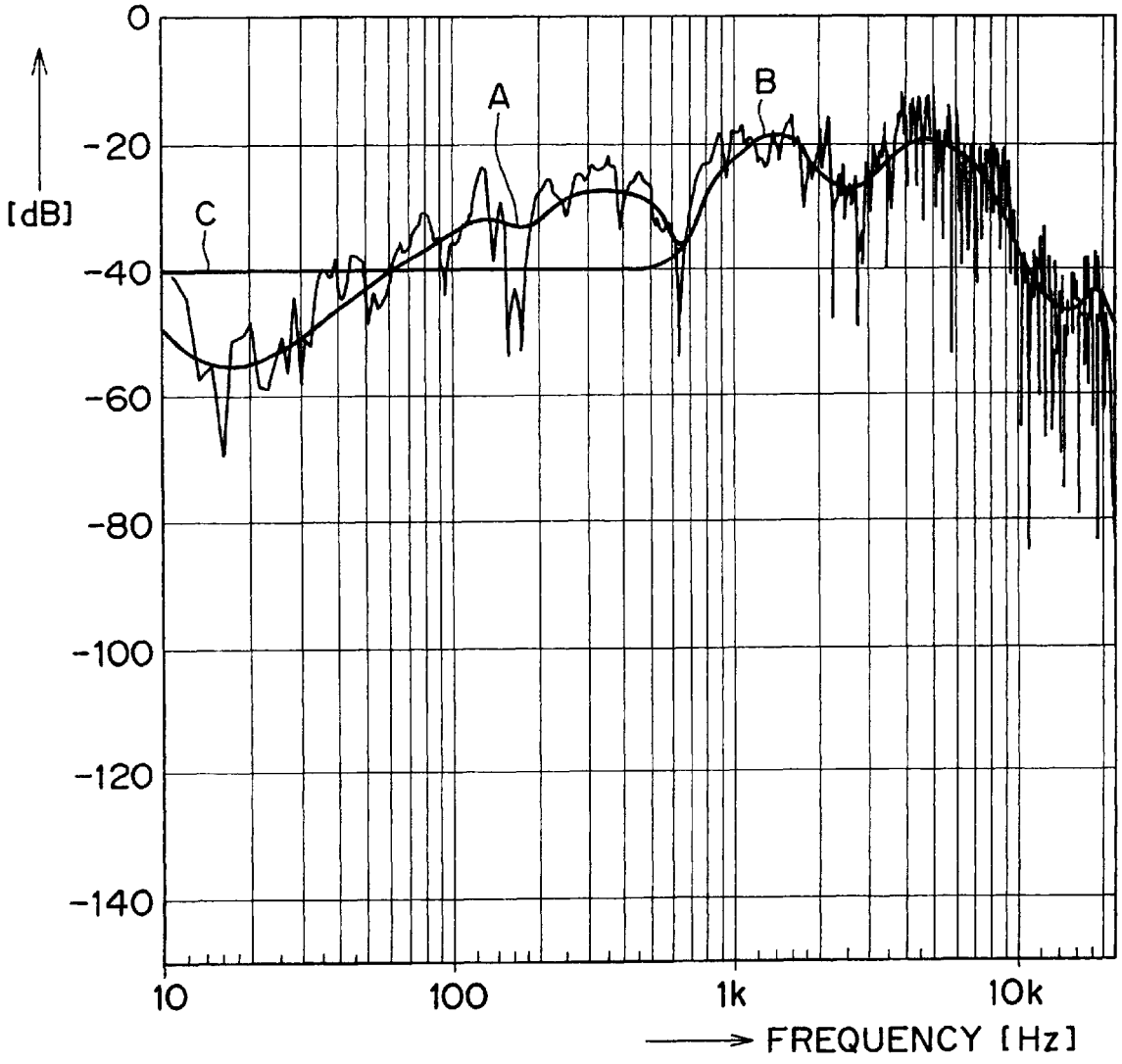
FIG. 7 is a characteristic diagram of assistance in explaining the present invention.

By averaging amplitude on the frequency axis of the result of measurement in FIG. 6, for example, the steep peaks and dips are flattened, and tendency of the impulse response as a whole is used. For example, the amplitude of the result of measurement in FIG. 6 is averaged to thereby obtain characteristics of curves A and B in FIG. 7, and then the filter circuits 523A and 523B are configured according to the characteristics of the curves A and B.

(b) Flattening of Data

Figure 8:
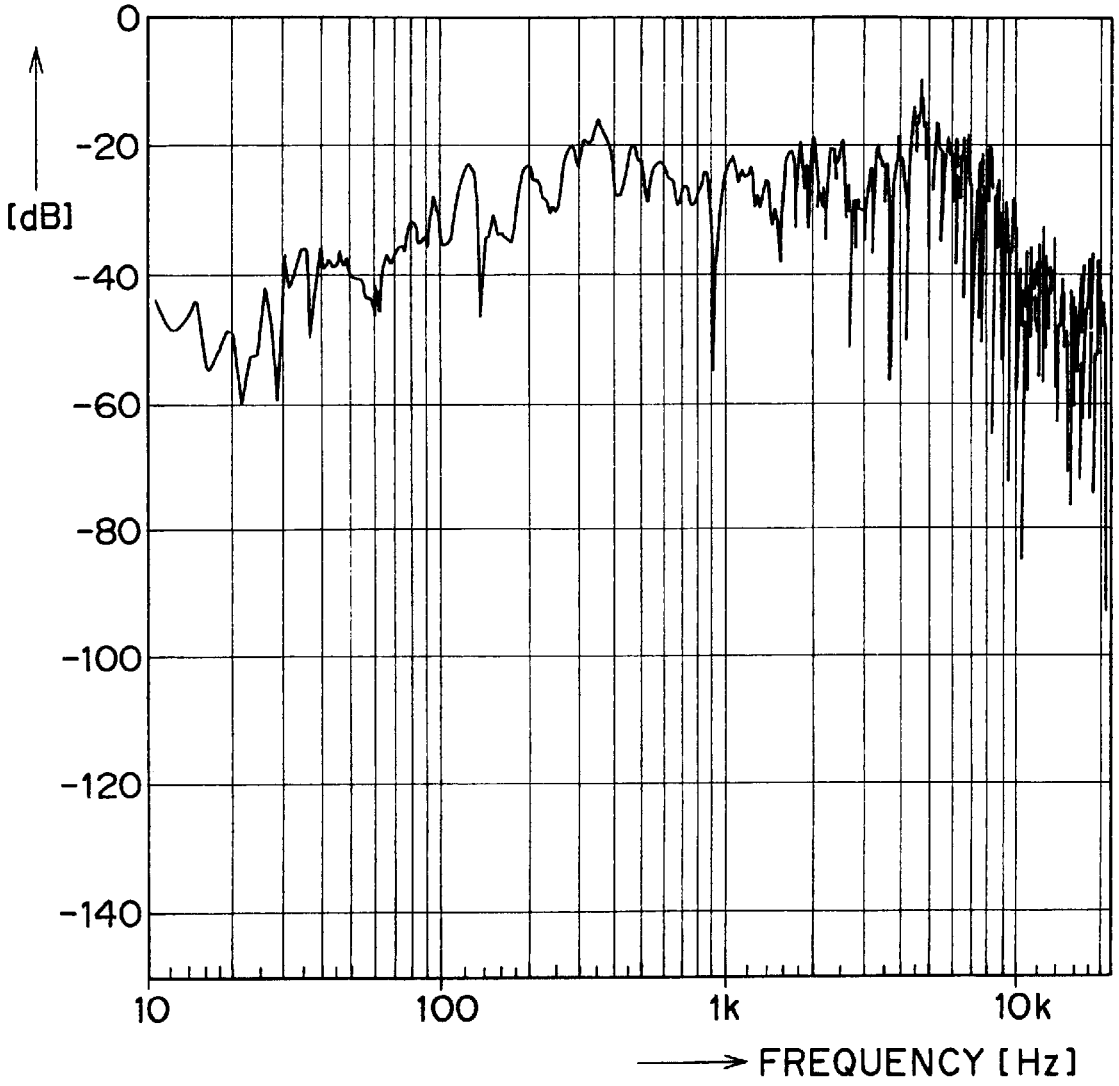
FIG. 8 is a characteristic diagram of assistance in explaining the present invention.
Figure 9:
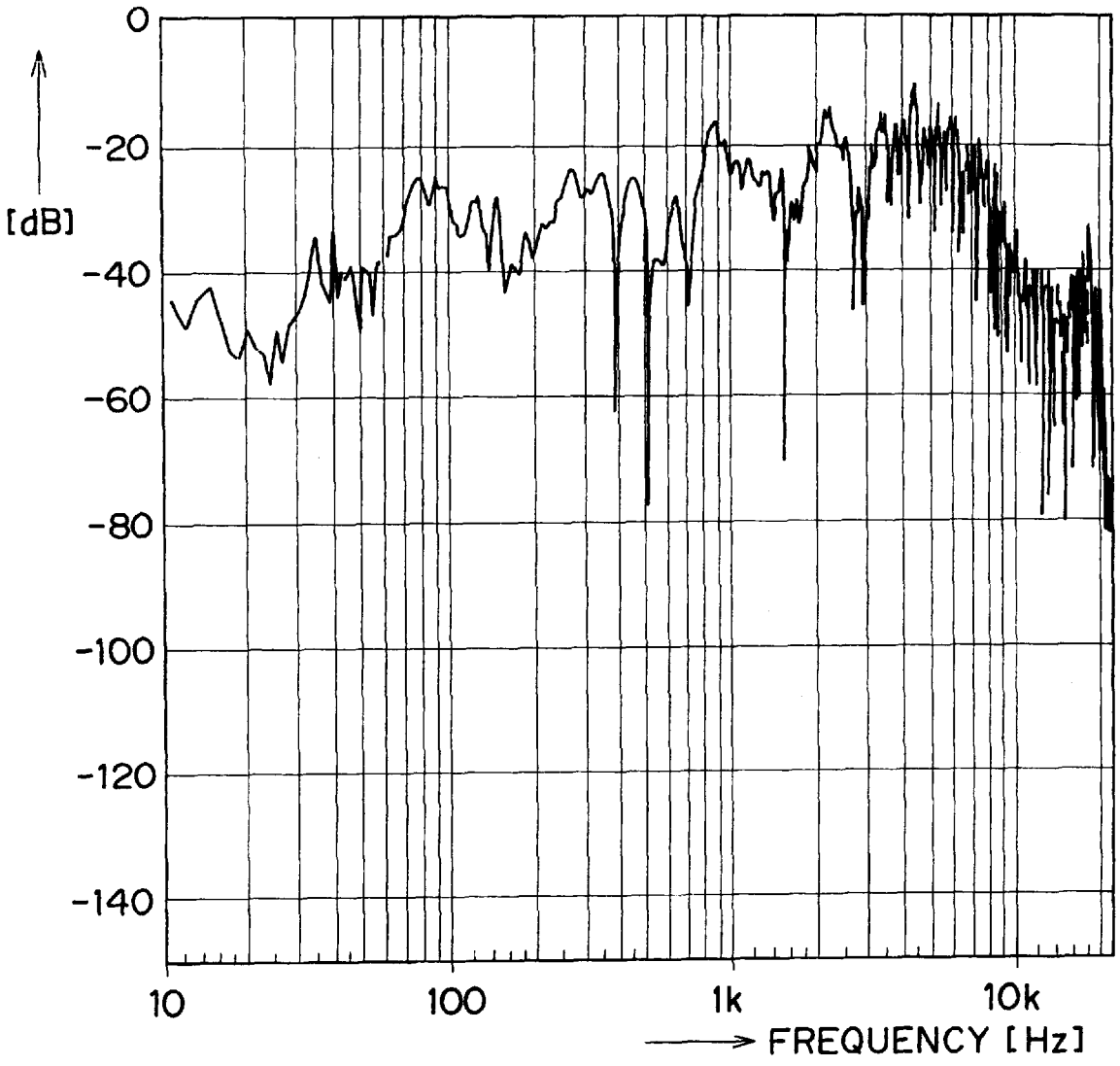
FIG. 9 is a characteristic diagram of assistance in explaining the present invention.

FIGS. 8 and 9 each show another example of measurement of impulse response. FIG. 8 shows a result of measurement of impulse response from the speaker disposed at the door position (1) on the left side of the front seats of the vehicle to the left ear of the dummy head DM disposed in the left front seat. FIG. 9 shows a result of measurement of impulse response from the speaker disposed at the door position (1) on the left side of the front seats of the vehicle to the left ear of the dummy head DM disposed in the right front seat.

In general, as is clear from the results of measurement of impulse response and the result of measurement of impulse response shown in FIG. 6, amplitude characteristics tend to differ greatly according to the measurement position in the passenger compartment in a frequency band lower than 1 kHz. This is because of the enclosed space of the compartment and effect of resonance (standing wave) in the compartment. Therefore, correcting a component in such a low range means limiting listening positions. In addition, in order to correct a low-range component, the order of the filters needs to be increased sufficiently.

Thus, correction is not made in the frequency band lower than 1 kHz. Specifically, as shown by a straight line C in FIG. 7, the response amplitude at less than 1 kHz is flattened at its average level. Then, the filter circuits 523A and 523B are configured according to the characteristics of the straight line C and the curve B.

(c) Phase Minimization

As a method for reducing the order of the filters, there is a method referred to as phase minimization.

When the equations (7) and (8) are calculated, phase minimization is performed for each of calculations of the numerators and the denominators, and then the division is performed. This reduces the order of the filter circuits 523A and 523B.

Also, when phase minimization is performed on results of the division of the equations (7) and (8) with the numerators and the denominators, the order of the filter circuits 523A and 523B can be further reduced.

According to experiments, however, a result of correction of a sound image is better when phase minimization is performed for each of calculations of the numerators and the denominators and then the division is performed than when phase minimization is performed on results of the division with the numerators and the denominators.

The above items (a) to (c) make it possible to reduce the order of the filter circuits 523A and 523B and thus simplify the sound image position correction circuit 52.

Depth Correction Circuit 53

Figure 3:
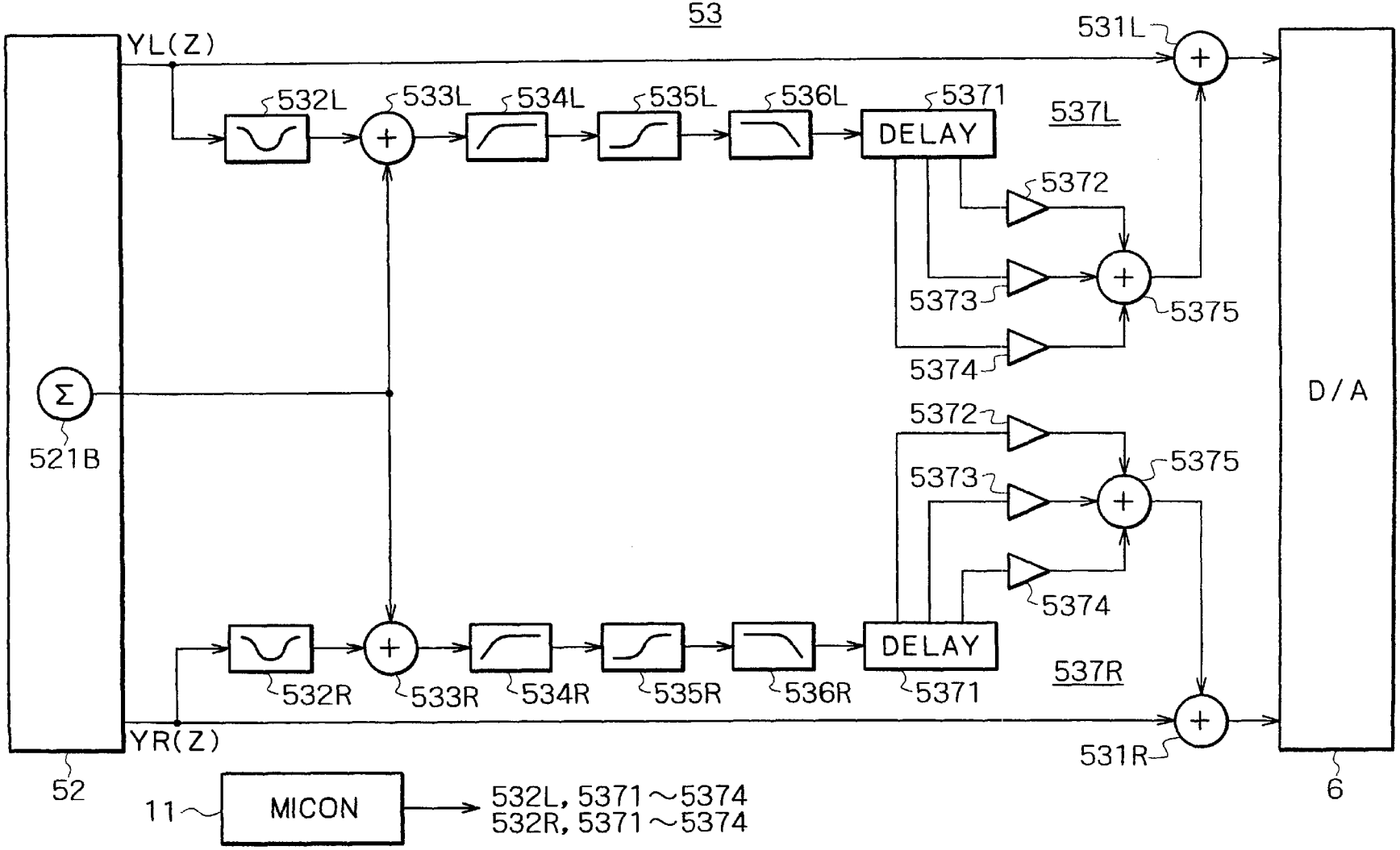
FIG. 3 is a system diagram showing the embodiment of the present invention.

In general, by simulating sound reflected from a wall, a ceiling and the like of a room or a hall, it is possible to add depth to reproduced sound. The depth correction circuit 53 adds depth to reproduced sound by adding a signal of reflected sound to a signal of direct sound (original signal). The depth correction circuit 53 is formed in a manner as shown in FIG. 3, for example.

The output signals (digital audio data) YL(Z) and YR(Z) of the sound image position correction circuit 52 correspond to direct sound, and the signals YL(Z) and YR(Z) are supplied to the D/A converter circuit 6 via adding circuits 531L and 531R. The signals YL(Z) and YR(Z) are also supplied to processing circuits 532L and 532R to 537L and 537R, which will be described later, to form signals of specified reflected sound. The signals of the reflected sound are supplied to the adding circuits 531L and 531R.

Thus, the adding circuits 531L and 531R add the signals of the reflected sound to the signals of direct sound, and then supply resulting output signals to the D/A converter circuit 6. The adding circuits 531L and 531R thereby add the reflected sound to the direct sound. Therefore, it is possible to obtain reproduced sound with greater depth.

(a) Blurred Sound Image of Vocal

As described above, by adding the reflected sound to the direct sound, it is possible to add depth to the reproduced sound. However, adding to the direct sound a merely delayed sound as the reflected sound results in less effect on a sense of depth and in a blurred sound image of a vocal of music.

Accordingly, the correction circuit 53 of FIG. 3 forms a signal of reflected sound as follows. The output signals YL(Z) and YR(Z) of the sound image position correction circuit 52 are supplied to band attenuation filters 532L and 532R. The filters 532L and 532R limit a vocal component in a musical signal, thereby preventing the blurring of a sound image of the vocal when the signal of reflected sound is added to the signal of direct sound.

Thus, the filters 532L and 532R are of the IIR type of order 2, for example, and have the following properties (enclosed in parentheses are optimum values).

Center frequencies: 500 Hz to 3 kHz (800 Hz)

Amount of attenuation at center frequencies: 6 dB to 30 dB (19 dB)

Q at center frequencies: 1.0 to 3.0 (2.0)

(b) Level Compensation of Reflected Sound Signal

The filters 532L and 532R reduce energy possessed by a signal. Therefore, output signals of the filters 532L and 532R are supplied to adding circuits 533L and 533R, and also the difference signal (XL(Z)—XR(Z)) outputted from the subtracting circuit 521B of the sound image position correction circuit 52 is supplied to the adding circuits 533L and 533R. Then, an attenuation-compensated signal is extracted from the adding circuits 533L and 533R.

Incidentally, in this case, the difference signal supplied from the subtracting circuit 521B to the adding circuits 533L and 533R is for example at a level 6 dB lower than that of the signals supplied from the filters 532L and 532R to the adding circuits 533L and 533R.

(c) Muddiness of Bass Sound

When a low-frequency component is included in reflected sound, the low-frequency sound becomes muddy, which is not desirable from a viewpoint of auditory sensation. Therefore, output signals of the adding circuits 533L and 533R are supplied to high-pass filters 534L and 534R to remove the low-frequency component that is undesirable from a viewpoint of auditory sensation. The filters 534L and 534R are of the IIR type of order 2, for example, and have the following properties (enclosed in parentheses are optimum values).

Cutoff frequency: 50 Hz to 400 Hz (200 Hz)

Q at center frequencies: 0.7071 (0.7071)

(d) Improvement in Depth

According to experiments, changing quality of reflected sound and adding a sound localized at a different position as reflected sound are effective in improvement in depth.

Accordingly, output signals of the filters 534L and 534R are supplied to high boost filters 535L and 535R So that the quality of the reflected sound is changed. The filters 535L and 535R are of the IIR type of order 2, for example, and have the following properties.

Turnover frequency: 800 Hz to 2 kHz

Amount of boost at high frequencies: 3 dB to 8 dB (e) High Frequency Correction

The filters 535L and 535R tend to emphasize high frequencies more than necessary. Thus, output signals of the filters 535L and 535R are supplied to low-pass filters 536L and 536R so that the high frequencies are suppressed. The filters 536L and 536R are of the IIR type of order 2, for example, and have the following properties (enclosed in parentheses are optimum values).

Cutoff frequency: 2 kHz to 10 kHz (3 kHz)

Q at center frequencies: 0.7071 (0.7071)

(f) Simulation of Reflected Sound

A signal of reflected sound, which is an end of the depth correction circuit 53, can be obtained by delaying output signals of the filters 536L and 536R. Thus, the output signals of the filters 536L and 536R are supplied to reflected sound signal generating circuits 537L and 537R. In the case of FIG. 3, each of the generating circuits 537L and 537R comprises: a delay circuit 5371 having three taps; coefficient circuits 5372 to 5374 to which tap outputs of the delay circuit 5371 are supplied, respectively; and an adding circuit 5375 for adding output signals of the coefficient circuits together.

In this case, when it is supposed that one sampling period $\tau$ of the digital audio data is $\tau$=1/44.1 kHz, the generating circuit 537L has the following properties, for example (enclosed in parentheses are optimum values).

Delay time at first tap of delay circuit 5371: 840 $\tau$ (552 $\tau$)

Delay time at second tap of delay circuit 5371: 2800 $\tau$ (1840 $\tau$)

Delay time at third tap of delay circuit 5371: 3500 $\tau$ (2300 $\tau$)

Coefficient (gain) of coefficient circuit 5372: −18 dB

Coefficient (gain) of coefficient circuit 5373: −14 dB

Coefficient (gain) of coefficient circuit 5374: −14 dB

The generating circuit 537R has the following properties, for example (enclosed in parentheses are optimum values).

Delay time at first tap of delay circuit 5371: 770 $\tau$ (506 $\tau$)

Delay time at second tap of delay circuit 5371: 2800 $\tau$ (1840 $\tau$)

Delay time at third tap of delay circuit 5371: 3360 $\tau$ (2208 $\tau$)

Coefficient (gain) of coefficient circuit 5372: −18 dB

Coefficient (gain) of coefficient circuit 5373: −14 dB

Coefficient (gain) of coefficient circuit 5374: −14 dB

Thus, the adding circuits 5375 and 5375 each output a signal of reflected sound with appropriately corrected frequency characteristics. Then, the signals of reflected sound outputted from the adding circuits 5375 and 5375 are supplied to the adding circuits 531L and 531R, as described above, to be thereby added to the signals YL(Z) and YR(Z) of direct sound.

Incidentally, in this case, the signals of reflected sound supplied to the adding circuits 531L and 531R are for example at a level 6 dB lower than that of the signals YL(Z) and YR(Z) of direct sound. Also, in this case, when the level of the reflected sound signals and the delay time of the delay circuits 5371 and 5371 are made variable, sound depth can be changed.

Frequency Characteristic Correction Circuit 51

Figure 4:
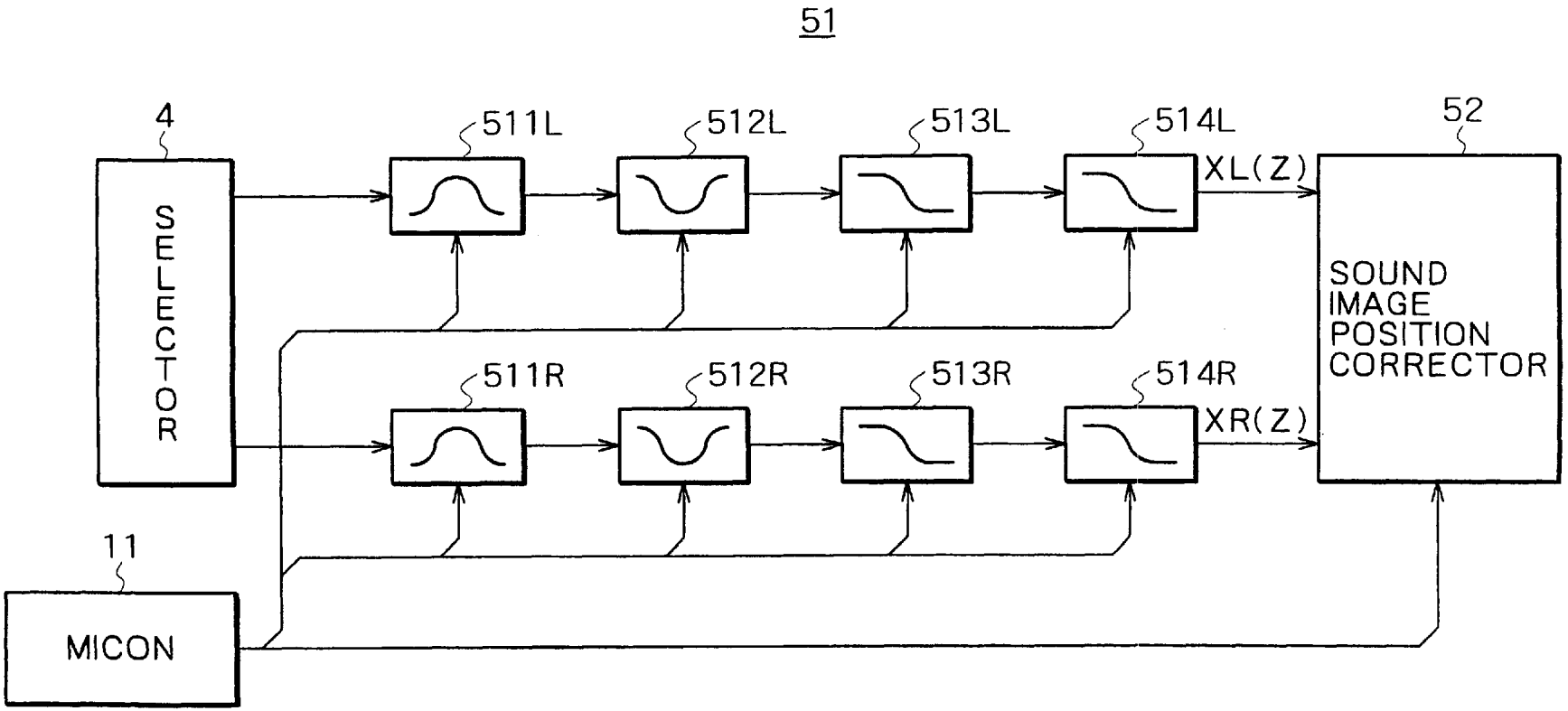
FIG. 4 is a system diagram showing the embodiment of the present invention.

The frequency characteristic correction circuit 51 is formed in a manner as shown in FIG. 4, for example. The frequency characteristic correction circuit 51 makes various frequency characteristic corrections as described below to thereby realize a more appropriate sound image or reproduced sound field.

(a) Correction of Low-frequency Component

The correction of the position of a sound image as described above generally tends to result in an increase in high-frequency level. Accordingly, output signals of the selector 4 in the correction circuit 51 of FIG. 4 are supplied to band boost filters 511L and 511R to boost low frequencies. The frequency balance of the output sound is thus corrected.

The filters 511L and 511R are of the IIR type of order 2, for example, and have the following properties (enclosed in parentheses are optimum values).

Center frequencies: 20 Hz to 120 Hz (62 Hz) Amount of boost at center frequencies: 2 dB to 18 dB (6.0 dB)

Q at center frequencies: 1.0 to 3.0 (1.2)

(b) Reduction of Resonance (standing wave) Effect in Compartment

The inside of the passenger compartment is an enclosed space of complex shape. The enclosed space causes "intra-compartment resonance phenomenon," in which a standing wave is formed as a result of resonance with sound outputted from speakers.

According to studies, the effect of the intra-compartment resonance phenomenon is generally most noticeable in a frequency band lower than 800 Hz. This results in "muffled sound." Hence, when output level of sound in a frequency band of 100 Hz to 800 Hz is lowered, the muffled sound can be reduced without greatly affecting perceived quality of a musical signal.

Thus, output signals of the filters 511L and 511R in the frequency characteristic correction circuit 51 are supplied to band attenuation filters 512L and 512R to reduce resonance in the compartment.

The filters 512L and 512R are of the IIR type of order 2, for example, and have the following properties (enclosed in parentheses are optimum values).

Center frequencies: 150 Hz to 600 Hz (300 Hz)

Amount of attenuation at center frequencies: 3 dB to 6 dB (3 dB)

Q at center frequencies: 2.0 to 4.0 (3.0)

(c) Effect Adjustment Interlocked with Sound Volume Adjustment

As described above, the foregoing correction of the position of a sound image generally tends to result in an increase in high-frequency level. As a result, when the sound volume is increased, high-frequency sound becomes excessively noticeable.

Accordingly, output signals of the filters 512L and 512R are supplied to variable high-frequency attenuation filters (shelving filters) 513L and 513R. The filters 513L and 513R are also supplied with a signal for controlling the amount of attenuation at high frequencies from the microcomputer 11.

The filters 513L and 513R are of the IIR type of order 1, for example, and have the following properties (enclosed in parentheses are optimum values).

Turnover frequency: 1 kHz to 3 kHz (2.5 kHz)

Amount of attenuation at high frequencies: 0 dB to 12 dB

When a sound volume adjusting key of the keys 12 is operated, the microcomputer 11 controls the amount of attenuation in the attenuator circuit 7 to thereby adjust the volume of reproduced sound. The microcomputer 11 simultaneously controls the amount of attenuation at high frequencies in the filters 513L and 513R such that the larger the sound volume, the larger the amount of attenuation at high frequencies in the filters 513L and 513R.

Therefore, high-frequency sound is suppressed at a high volume level. It is thus possible to perform appropriate reproduction at any volume level and also readily effect control of the reproduction.

(d) Case Where High-frequency Speakers are Mounted in Vehicle

Some types of vehicles have high-frequency speakers disposed around the position (3) in FIG. 12A. When the foregoing correction of the sound image position is made, the sound image is corrected to be at the position (3). Therefore, provision of such high-frequency speakers does not result in separate sound images.

When the high-frequency speakers are disposed around the position (3), however, more high-frequency sound reaches the listener than when speakers are disposed only at the position (1), whereby high-frequency sound is emphasized.

Accordingly, output signals of the filters 513L and 513R are supplied to high-frequency attenuation filters (shelving filters) 514L and 514R to attenuate the high-frequency sound. Output signals of the filters 514L and 514R are supplied as output signals of the frequency characteristic correction circuit 51.

Thus, the filters 514L and 514R are of the IIR type of order 1, for example, and have the following properties (enclosed in parentheses are optimum values).

Turnover frequency: 3 kHz to 8 kHz (1 kHz) Amount of attenuation at high frequencies: 0 dB to 12 dB, variable by user Incidentally, when the high-frequency speakers are not disposed (around the position (3)), the amount of attenuation at high frequencies in the filters 514L and 514R may be set to 0 dB.

Summary

As described above, the automotive audio reproducing apparatus shown in FIGS. 1 to 4 has virtual speakers disposed at a position where real speakers cannot be mounted, thereby making it possible to provide a sense of hearing reproduced sound outputted from the virtual speakers. It is therefore possible to create an ideal sound field and sound image in the compartment.

Accordingly, it is possible to prevent localization of the sound image at a lower position and thus localize the sound image at ideal eye level. It is also possible to solve a problem caused when small speakers for reproducing high frequencies are disposed at an upper position, that is, a problem of hearing separate sound images, and thereby it is possible to provide a sense of hearing sound outputted from a single speaker.

Moreover, the spatial breadth of the sound field can be corrected by controlling the level of the differential component. It is also possible to make optimum correction according to sound volume level. In addition, the depth correction circuit 53 is provided to include reflected sound in reproduced sound. Therefore, it is possible to obtain reproduced sound with greater depth.

Furthermore, the sound image position correction circuit 52 can be simplified, and thus even a DSP having limited processing capabilities can attain the expected end. In addition, optimum correction can be made for a type of vehicle having an arbitrary shape only by determining the transfer function.

Furthermore, an effective correction filter circuit for a plurality of types of vehicles can be produced by averaging a plurality of transfer functions. Thus, the correction filter circuit can be put into wide use for any type of vehicle.

Outline of Automotive Audio Reproducing Apparatus (2)

Ideally, in general, a left and a right speaker for stereo reproduction should be disposed at symmetrical positions with respect to the listener and a sound image reproduced by the speakers should be localized in front of the listener.

Figure 12B:
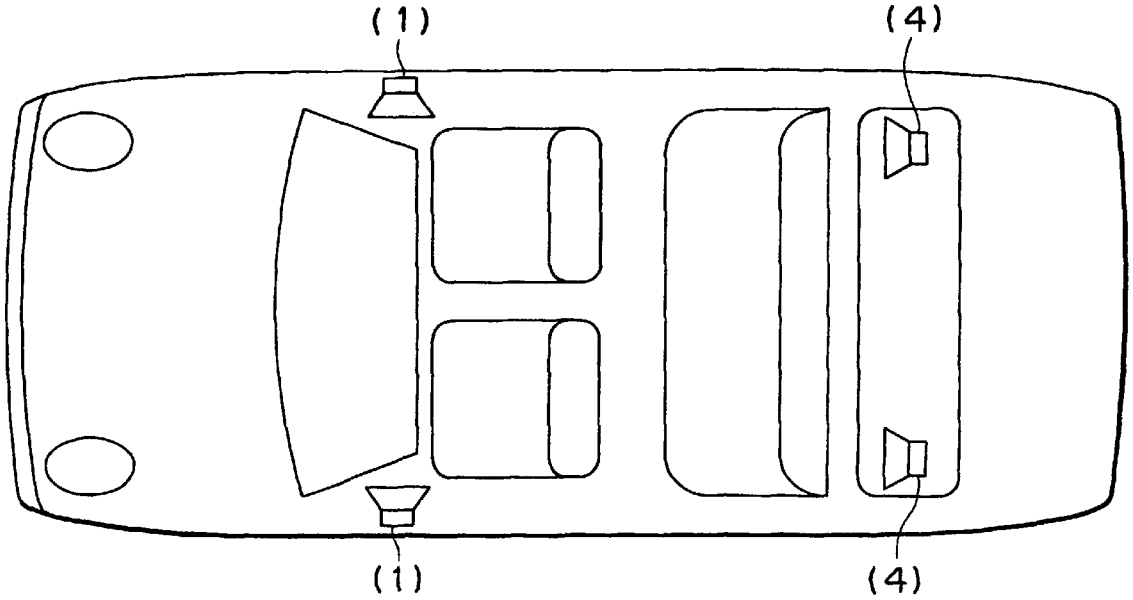

However, as described with reference to FIG. 12A, the speakers of the automotive audio reproducing apparatus are often disposed at the lower position (1) of the front doors for the front seats and at a lower position (2) of the rear doors or at a position (4) of a rear tray as shown in FIG. 12B for the rear seats.

Thus, a reproduced sound outputted from the speaker disposed on the right front side first reaches an occupant in the right front seat, for example, and then reproduced sounds outputted from the other speakers reach the occupant after delays. Therefore, the occupant hears the reproduced sounds that are out of phase with each other, so that precise sound localization is not possible.

Some automotive audio reproducing apparatus have a function referred to as a "seat position function," which realizes an optimally reproduced sound field according to the seated position of the occupant (seat position).

Figure 10:
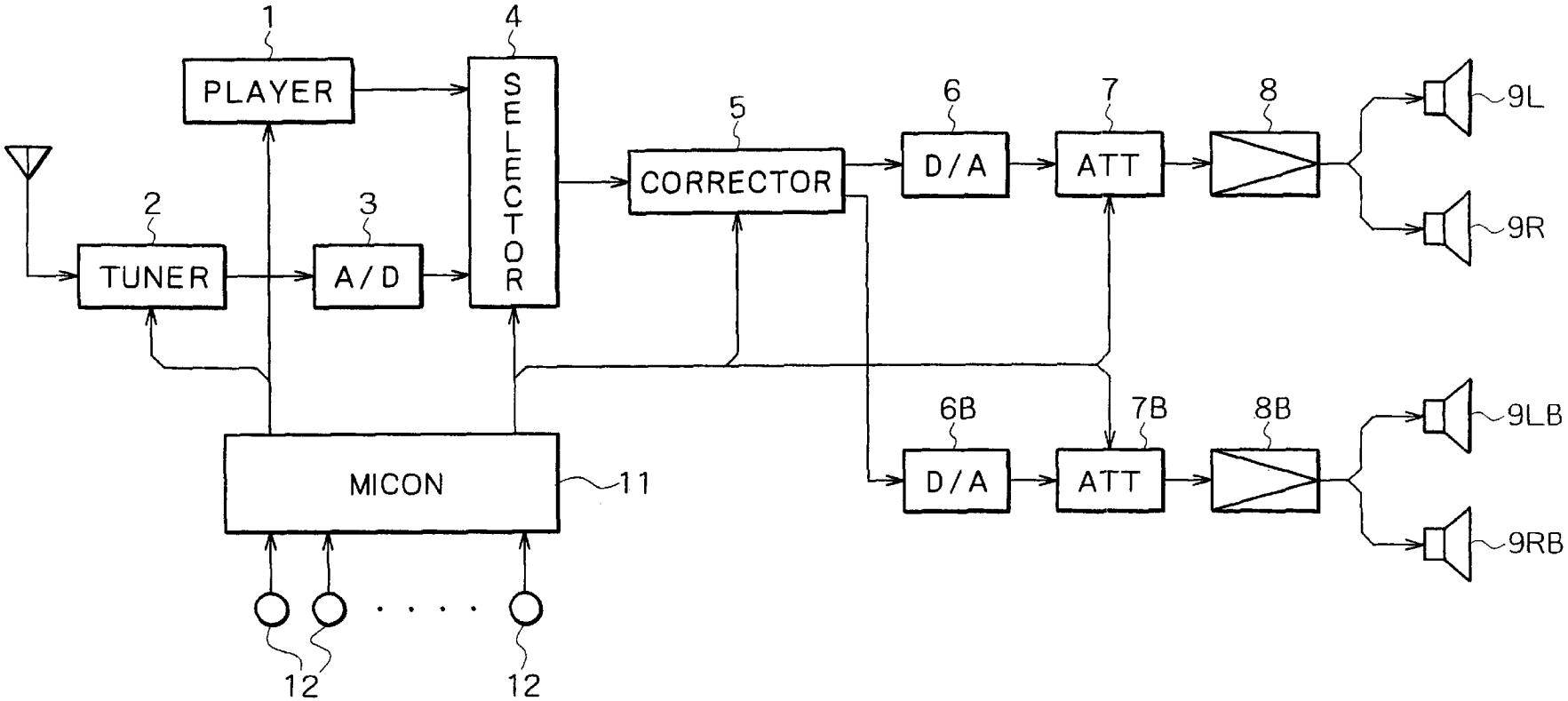
FIG. 10 is a system diagram showing another embodiment of the present invention.

FIG. 10 shows a case where the present invention is applied to an automotive audio reproducing apparatus having the seat position function. Processing means 1 to 9L and 9R are formed in the same manner as in the apparatus of FIG. 1 except for part of a digital correction circuit 5. Digital audio data of a left and a right channel for the rear seats is extracted from the digital correction circuit 5, which will be described later in detail.

Delay time and frequency characteristics of the digital audio data are corrected according to the seat position function. The digital audio data is supplied to a D/A converter circuit 6B to be converted into an analog audio signal.

The audio signal is supplied through an attenuator circuit 7B for adjusting sound volume and then an output amplifier 8B to left- and right-channel speakers 9LB and 9RB. In this case, the speakers 9LB and 9RB are disposed at the position (2) in FIG. 12A or at the position (4) in FIG. 12B, for example.

Thus, a sound image formed by sounds reproduced by the speakers 9L, 9R, 9LB, and 9RB is located at eye level of the listener, for example, and the reproduced sounds provide a sense of greater breadth and depth. In this case, these effects can be obtained regardless of the seated position of the listener.

Digital Correction Circuit 5 (2)

Figure 11:
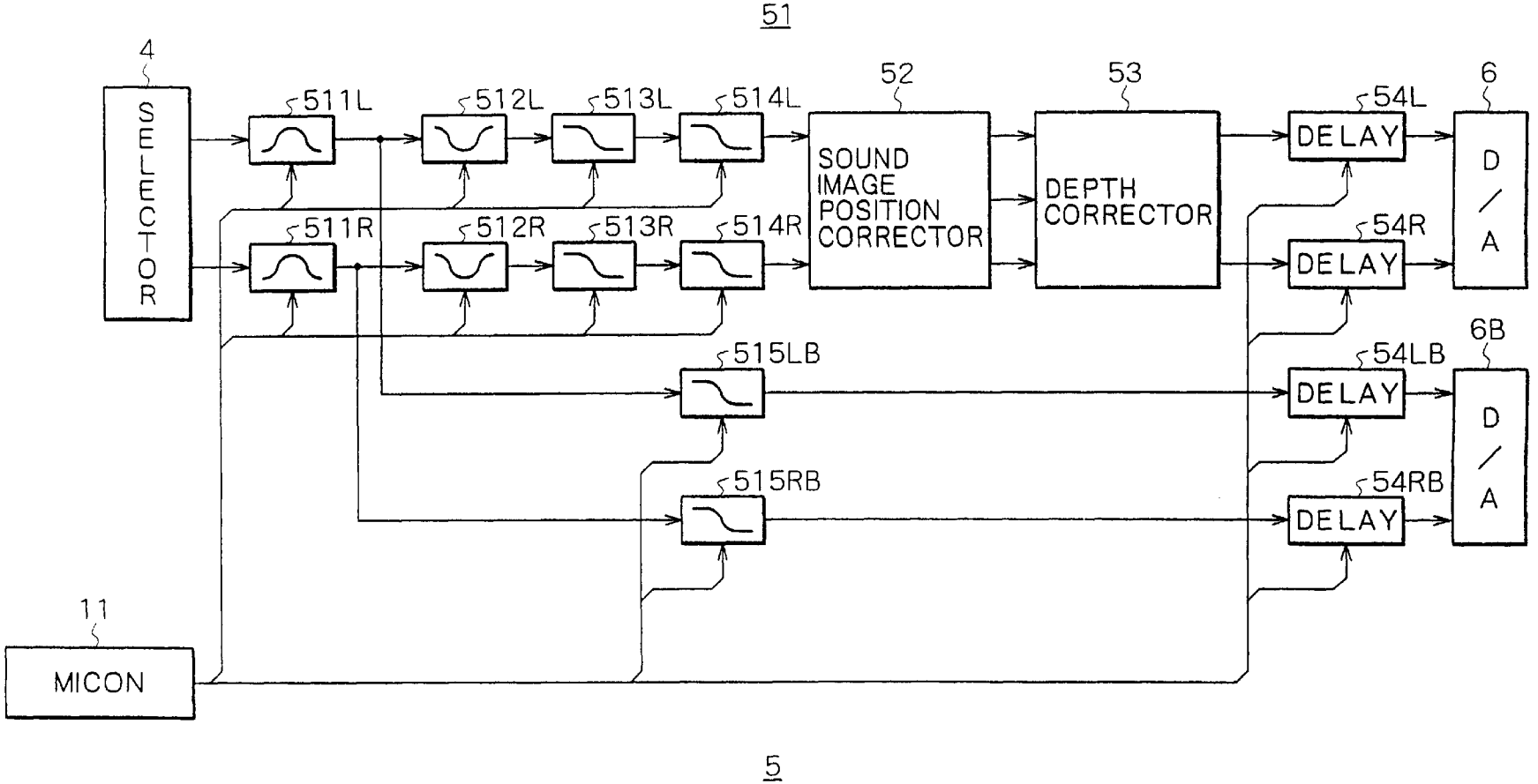
FIG. 11 is a system diagram showing the other embodiment of the present invention.

The digital correction circuit 5 is formed in a manner as shown in FIG. 11, for example, to realize the seat position function. Specifically, digital audio data outputted from a depth correction circuit 53 is supplied to a D/A converter circuit 6 via delay circuits 54L and 54R to be converted into an analog audio signal.

A low-frequency component does not much affect localization of a sound image. However, in order to improve perceived quality of low-frequency sound, digital audio data outputted from filters 511L and 511R is supplied to variable high-frequency attenuation filters (shelving filters) 515LB and 515RB to attenuate high-frequency sound.

In this case, when the "seat position" is set to be some position in the front seats, that is, either the front seats, the right front seat, or the left front seat, the filters 515LB and 515RB suppress a high-frequency component of reproduced sound outputted from the rear speakers 9LB and 9RB, thereby preventing the sound image from being pulled in a rear direction.

Thus, the filters 515LB and 515RB are of the IIR type of order 1, for example, and have the following properties.

Turnover frequency: 3 kHz

Amount of attenuation at high frequencies: controlled by microcomputer 11

Output signals of the filters 515LB and 515RB are supplied to a D/A converter circuit 6B via delay circuits 54LB and 54RB to be converted into analog audio signals.

The delay circuits 54L, 54R, 54LB, and 54RB are provided to adjust the phases of the reproduced sounds outputted from the speakers 9L, 9R, 9LB, and 9RB according to the seated position of the occupant. The delay circuits 54LB and 54RB are provided so that the reproduced sounds outputted from the front speakers 9L and 9R reach the occupant in a front seat 10 ms to 20 ms earlier than the reproduced sounds outputted from the rear speakers 9LB and 9RB. The delay time of the delay circuits 54L to 54RB is controlled by the microcomputer With such a configuration, when a predetermined key of the control keys 12 is operated to input the seated position of the occupant, the microcomputer 11 responds to the operation to control the amount of attenuation at high frequencies in the filters 515LB and 515RB and the delay time of the delay circuits 54L to 54RB. Therefore, the delay circuits 54L to 54RB enable the reproduced sounds outputted from the speakers 9L to 9RB to be in phase with each other when reaching the occupant. As a result, it is possible to precisely localize the sound image.

In addition, since the filters 515LB and 515RB attenuate the high-frequency component of the reproduced sounds outputted from the rear speakers 9LB and 9RB, the position of the sound image perceived by the occupant in a front seat will not be pulled in a rear direction. This also contributes to the precise localization of the sound image.

Also, the auditory sensation of the human has p-precedence effect (Haas effect), that is, a characteristic of perceiving sound arriving about 10 ms to 20 ms earlier to be emphasized. Since the delay circuits 54LB and 54RB make the reproduced sounds outputted from the front speakers 9L and 9R precede the reproduced sounds outputted from the rear speakers 9LB and 9RB by 10 ms to 20 ms, the reproduced sounds outputted from the front speakers 9L and 9R are emphasized. Therefore, it is possible to localize the sound image in front without decreasing the overall sound volume.

Moreover, since the low-frequency component that does not much affect the localization of the sound image is outputted from the speakers 9LB and 9RB, overall sound pressure level is not lowered, or thickness of low-frequency sound is not reduced. Also, since the rear speakers of an automotive audio system are generally of larger diameter than the front speakers, it is possible to make full use of performance of the speakers 9LB and 9RB for low-frequency output.

Furthermore, because of the precedence effect, the reproduced sounds outputted from the front speakers 9L and 9R are perceived to be emphasized; therefore even when the performance of the DSP and the like allow signal processing such as graphic equalizer processing to be set only in the signal lines of audio signals supplied to the front speakers 9L and 9R, the effects of the processing are produced in the entire compartment.

Other

In the above description, the seated position of the occupant is inputted by means of a control key 12. However, the seated position of the occupant may also be detected by means of an infrared sensor provided in the compartment or a pressure sensor provided in a seat so that the filters 515LB and 515RB and the delay circuits 54L to 54RB are controlled according to the detection output by the microcomputer 11 so as to have properties corresponding to the seated position.

List of Abbreviations Used in the Present Specification

A/D: Analog to Digital
CD: Compact Disc
D/A: Digital to Analog
DSP: Digital Signal Processor
FIR: Finite Impulse Response
FM: Frequency Modulation
HRTF: Head Related Transfer Function
IIR: Infinite Impulse Response
MD: Mini Disc
Q: Quality According to the present invention, the sound image can be localized at ideal eye level even when the mounting position of the speakers is limited. Also, it is possible to provide a sense of greater breadth and depth and adjust the sense of breadth and depth according to preference of the listener.

In addition, the correction filter circuit can be simplified, and thus even a DSP having limited processing capabilities can attain the expected end. Moreover, optimum correction can be made for a type of vehicle having an arbitrary shape only by determining the transfer function. Furthermore, an effective correction filter circuit for a plurality of types of vehicles can be produced by averaging a plurality of transfer functions. Thus, the correction filter circuit can be put into wide use for any type of vehicle.

What is claimed is:

1. An automotive audio reproducing apparatus comprising:

a sound image position correction circuit for converting a left-channel input digital audio signal XL(Z) and a right-channel input digital audio signal XR(Z) into a digital audio signal YL(Z) and a digital audio signal YR(Z), respectively, for output expressed by:

$$YL(Z)\cdot GLL(Z)+YR(Z)\cdot GLR(Z)=XL(Z)\cdot FLL(Z)+XR(Z)\cdot FLR(Z)$$

$$YR(Z)\cdot GLL(Z)+YL(Z)\cdot GLR(Z)=XR(Z)\cdot FLL(Z)+XL(Z)\cdot FLR(Z)$$

where

FLL(Z) is a head related transfer function from a first left-channel speaker and a first right-channel speaker located in front of a listener in a passenger compartment to a left ear and a right ear of said listener, respectively;

FLR(Z) is a head related transfer function from said first left-channel speaker and said first right-channel speaker to the right ear and the left ear of said listener, respectively;

GLL(Z) is a head related transfer function from a second left-channel speaker and a second right-channel speaker located in lower front of said listener to the left ear and the right ear of said listener, respectively; and GLR(Z) is a head related transfer function from said second left-channel speaker and said second right-channel speaker to the right ear and the left ear of said listener, respectively;

a reflected sound signal generating circuit for generating reflected sound signals by delaying said output signals YL(Z) and YR(Z), respectively;

a pair of adding circuits for adding said reflected sound signals to said output signals YL(Z) and YR(Z), respectively; and a D/A converter circuit for being supplied with output signals of the pair of adding circuits;

wherein when $$Hp(Z)=(FLL(Z)+FLR(Z))/(GLL(Z)+GLR(Z))$$

$$Hm(Z)=(FLL(Z)-FLR(Z))/(GLL(Z)-GLR(Z)),$$

said sound image position correction circuit includes:

a first adding circuit and a first subtracting circuit for subjecting said input digital audio signals XL(Z) and XR(Z) to addition and subtraction, respectively;

a first digital filter and a second digital filter having transfer characteristics of said Hp(Z) and said Hm(Z) for being supplied with output signals of said first adding circuit and said first subtracting circuit, respectively;

a second adding circuit and a second subtracting circuit for subjecting output signals of the first digital filter and the second digital filter to addition and subtraction and thereby generating said output signals YL(Z) and YR(Z), respectively; and a level control circuit connected in series with said second digital filter in a signal line between said first subtracting circuit and said second adding circuit and said second subtracting circuit;

whereby said level control circuit controls level of a difference signal supplied to said second adding circuit and said second subtracting circuit; and analog signals outputted from said D/A converter circuit are supplied to said second left-channel speaker and said second right-channel speaker, respectively.

2. An automotive audio reproducing apparatus as claimed in claim 1, wherein delay time or level of said reflected sound signals supplied to said pair of adding circuits is controlled.

3. An automotive audio reproducing apparatus as claimed in claim 2, further including a correction circuit for correcting frequency characteristics of said output signals YL(Z) and YR(Z) that become said reflected sound signals.

4. An automotive audio reproducing apparatus as claimed in claim 2, wherein a frequency characteristic correction circuit is provided in a stage preceding said sound image position correction circuit.

5. An automotive audio reproducing apparatus as claimed in claim 1, wherein at least said sound image position correction circuit, said reflected sound signal generating circuit, and said pair of adding circuits are formed by a DSP.

* * * * *